US006305986B1

(12) United States Patent
Hwang

(10) Patent No.: US 6,305,986 B1
(45) Date of Patent: Oct. 23, 2001

(54) CABLE CONNECTOR ASSEMBLY HAVING IMPROVED GROUNDING MEANS

(75) Inventor: Jeng-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/574,716

(22) Filed: May 18, 2000

(51) Int. Cl.[7] ..... H01R 13/648
(52) U.S. Cl. ..... 439/610; 439/358; 439/939
(58) Field of Search ..... 439/607–610, 439/939, 357, 358

(56) References Cited

U.S. PATENT DOCUMENTS

| | | | | |
|---|---|---|---|---|
| 5,797,771 | * | 8/1998 | Garside | 439/610 |
| 5,836,774 | * | 11/1998 | Tan et al. | 439/610 |
| 5,941,726 | * | 8/1999 | Koegel et al. | 439/358 |
| 6,056,578 | * | 5/2000 | Lin | 439/358 |
| 6,083,049 | * | 7/2000 | Kuo et al. | 439/939 |

* cited by examiner

*Primary Examiner*—Gary Paumen
(74) *Attorney, Agent, or Firm*—Wei Te Chung

(57) ABSTRACT

A cable connector assembly 1 includes a pair of USB connectors 10, a cable end 20 electrically connecting to the pair of USB connectors 10, a pair of conductive latches 40 positioned beside the USB connectors 10, a cover 30 enclosing the USB connectors 10 and a grounding bar 50 positioned on an outer surface of the cover 30. Each latch 40 is V-shaped and has a first arm 42 electrically engaging with a conductive shell 12 of the corresponding USB connector 10 and a second arm 44 extending out from the cover 30 to electrically and mechanically engage with a grounding panel 23 of an electronic apparatus 2 with which the cable connector 1 mates. The grounding bar 50 has a base portion 52 located on the cover 30 and a pair of conductive tabs 54 extending from the base portion 52 into the cover 30 and electrically engaging with the conductive shells 12 of the pair of USB connectors 10. When the cable connector 1 mates with the electronic apparatus 2, the pair of latches 40 and the grounding bar 50 electrically engage with the grounding panel 23 of the electronic apparatus 2 and connect the conductive shells 12 of the USB connectors 10 to a reference grounding potential.

1 Claim, 5 Drawing Sheets

CABLE CONNECTOR ASSEMBLY HAVING IMPROVED GROUNDING MEANS

BACKGROUND OF THE INVENTION

1. Field of the Invention

The present invention relates to a connector, and particularly to a cable connector assembly having a pair of grounding latches and a grounding bar for connecting to a grounding panel of a mating electronic apparatus to reduce EMI effects at the connection.

2. Description of the Prior Art

Generally, cable connectors are used to connect an electronic apparatus, such as a personal computer to a peripheral device, such as a printer. The cable connectors are typically shielded by conductive shells to protect the electronic signals transmitted therein from external electromagnetic interference. The conductive shells must be grounded to a reference potential to discharge static charge thereon and to effect the EMI protection. The conductive shells of the conventional cable connectors do not have sufficient grounding contact points to reliably connect them to a reference grounding potential, and so the static charge can not be reliably dissipated and the EMI protection is not as effective as it should be. Furthermore, a conventional cable connector does not have a device which can function both as a grounding path and as a latch for securely connecting the cable connector and an electronic apparatus together. The present invention is a cable connector assembly which resolves the above mentioned problems of the prior art.

BRIEF SUMMARY OF THE INVENTION

A first object of the present invention is to provide a cable connector assembly having a pair of grounding latches and a grounding bar for connecting to a grounding panel of a mating electronic apparatus to reduce the effects of EMI on the cable connector assembly;

A second object of the present invention is to provide a cable connector assembly having a pair of conductive latches for joining the cable connector to a mating electronic apparatus as well as for grounding the cable connector to a reference potential;

A third object of the present invention is to provide a cable connector assembly having a grounding bar for grounding the cable connector to a reference potential.

To fulfill the above objects, a cable connector assembly includes a pair of USB connectors, a cable end connecting to the pair of USB connectors, a pair of conductive latches positioned beside the USB connectors, a cover enclosing the USB connectors and a grounding bar positioned on an outer surface of the cover. Each latch is V-shaped and has a first arm electrically engaging with a conductive shell of the corresponding USB connector and a second arm extending out from the cover to electrically and mechanically engage with a grounding panel of an electronic apparatus with which the cable connector mates. The grounding bar has a base portion located on the cover and a pair of conductive tabs extending from the base portion into the cover and electrically engaging with the conductive shells of the pair of USB connectors. When the cable connector mates with the electronic apparatus, the pair of latches and the grounding bar electrically engage with the grounding panel of the electronic apparatus and connect the conductive shells of the USB connectors to a reference grounding potential.

Other objects, advantages and novel features of the invention will become more apparent from the following detailed description of the present embodiment when taken in conjunction with the accompanying drawings.

DETAILED DESCRIPTION OF THE INVENTION

In the following detailed description, reference is made to the accompanying drawings which form a part hereof, and in which is shown by way of illustration a specific embodiment in which the invention may be practiced. The embodiment is described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims.

Figure 1:
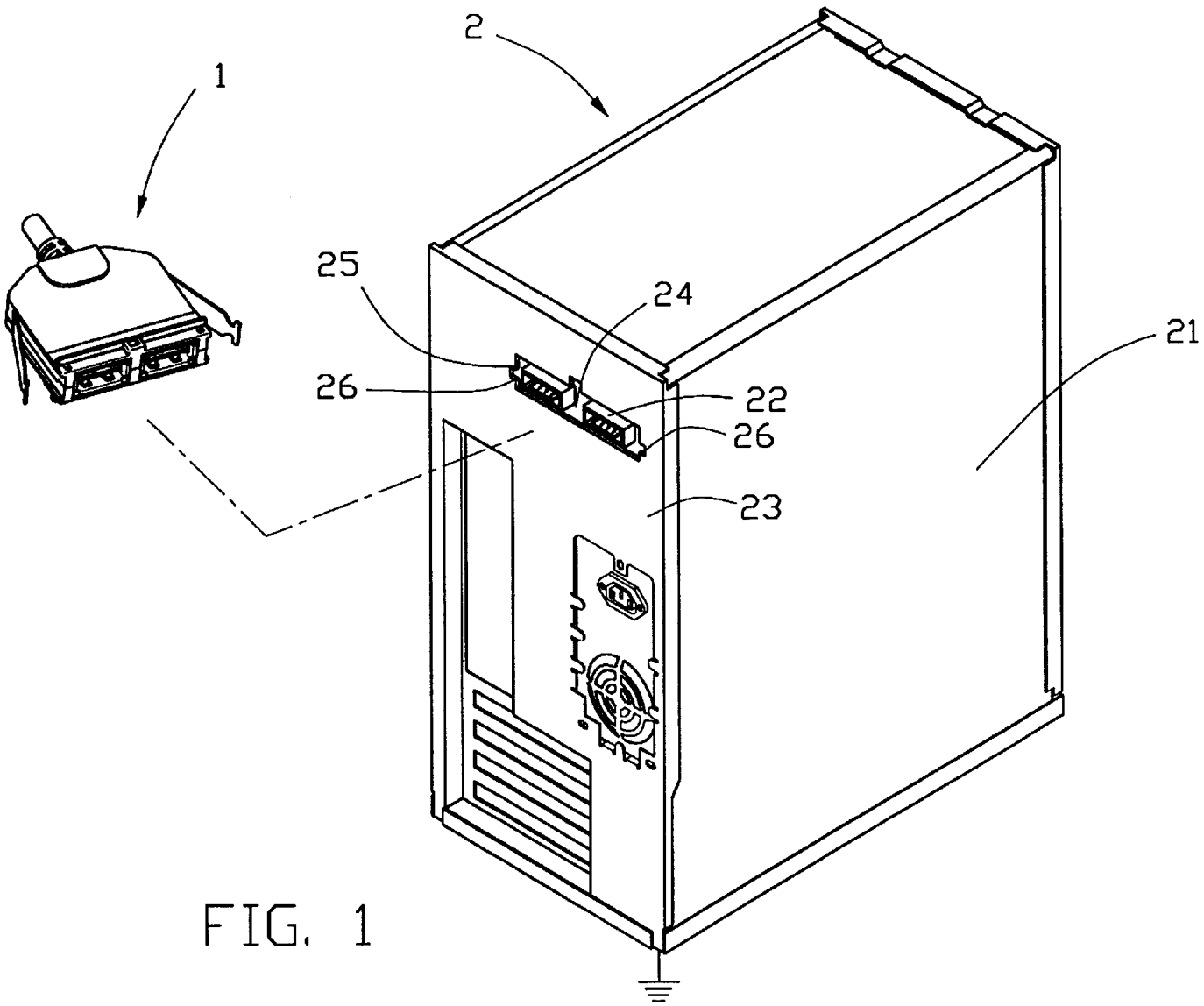
FIG. 1 is a perspective view of a cable connector assembly of the present invention and a host device with which the cable connector assembly is going to mate.
Figure 2:
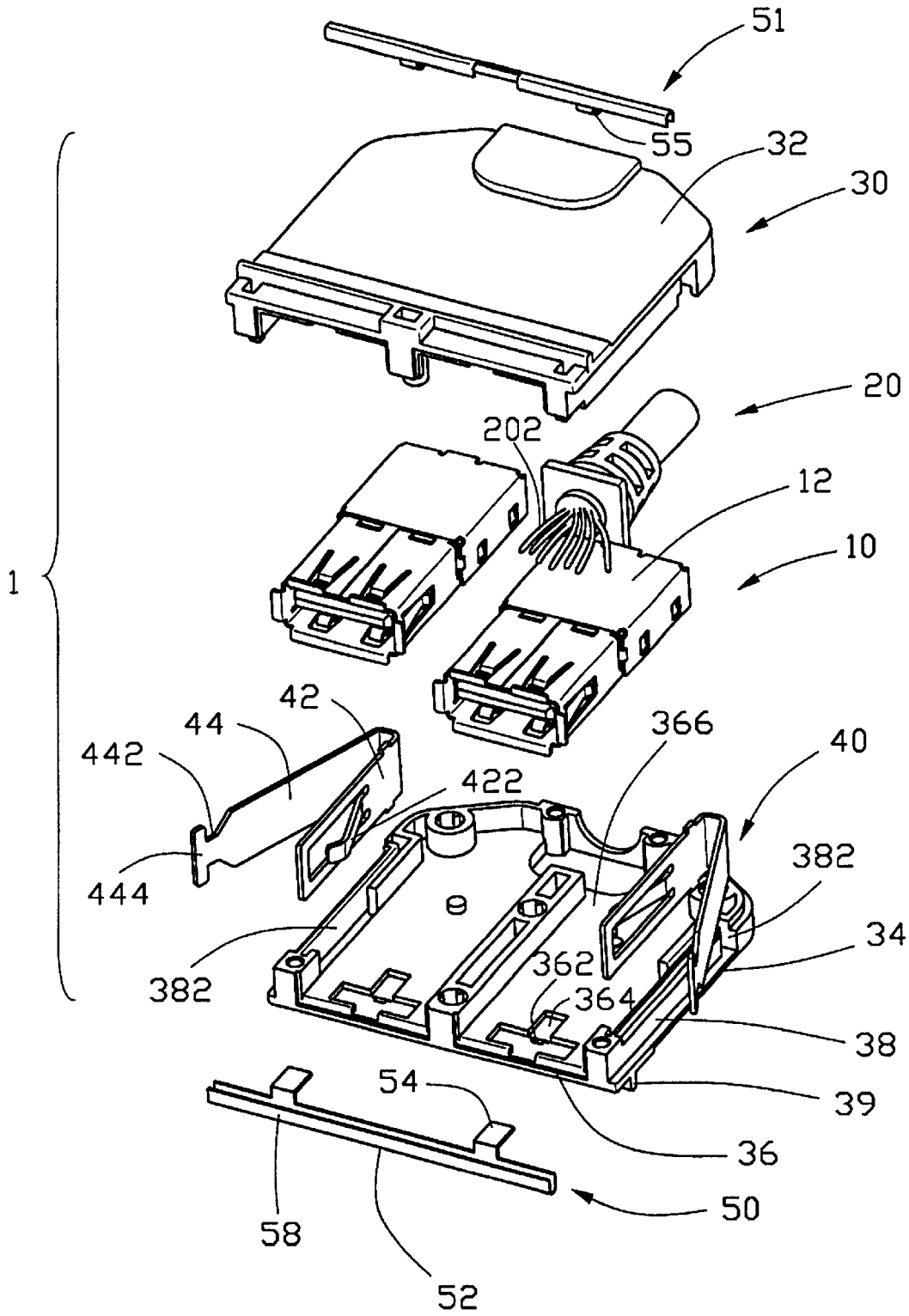
FIG. 2 is an enlarged exploded perspective view of the cable connector assembly of FIG. 1.

Referring to the drawings in detail, and first to FIGS. 1 and 2, the present invention relates to a cable connector assembly 1 that is electrically connected to an electronic apparatus 2, such as a host computer, for transmitting signals between the electronic apparatus and a complimentary device. The electronic apparatus 2 comprises a case 21, two first connectors 22 received in the case 21 and a grounding panel 23 mounted to a rear edge of the case 21, wherein the grounding panel 23 is electrically connected to a reference grounding potential in a manner known by those skilled in the art. The case 21 and the first connectors 22 are conventional, so details of them are omitted herein for conciseness. The grounding panel 23 defines a lengthwise opening 24 and four blocks 25 are formed adjacent to four corners of the opening 24, respectively. A notch 26 is defined in each opposite transverse side of the opening 24 and between two adjacent blocks 25 such that the cable connector assembly 1 can be reliably attached to the panel 23 of the electronic apparatus 2, as detailed below.

As shown in greater detail in FIG. 2, the cable connector assembly 1 of the present invention comprises a pair of second connectors 10 such as USB connectors, a cable end 20 connecting to the pair of second connectors 10, a cover 30 enclosing the pair of second connectors 10 and the cable end 20 therein, and grounding means comprising a pair of conductive latches 40 and first and second grounding bars 50, 51 partially received in the cover 30, respectively. Each second connector 10 has a shrouded shell 12 generally enclosing an insulative housing and terminals thereof (not labeled) for protecting electronic signals transmitted through the terminals from external electromagnetic interference. The second connectors 10 and the cable end 20 are generally conventional; detailed descriptions of them are therefore omitted herein for conciseness.

The cover 30 preferably comprises an upper cover 32 and a lower cover 34 that are combined together by bolts and nuts or by ultrasonic welding or other means after elements that are required to be received in the cover 30 are correctly positioned in the cover 30. The upper and lower covers 32, 34 are, generally in general terms, structural, mirror images of one other, so only the lower cover 34 is illustrated in great detail hereinafter and the upper cover 32 may be known by referring to the lower cover 34. The lower cover 34 comprises a body portion 36 and a peripheral wall 38 extending perpendicularly upwards from the body portion 36. The body portion 36 defines a pair of slots 362 therethrough and a recess 364 adjacent each slot 362 and recessed from an inner face 366 thereof. The body portion 36 further forms a rib 39 on an outer face thereof. The peripheral wall 38 defines a channel 382 in each opposite sidewall thereof for retaining the conductive latches 40 therein.

Each conductive latch 40 is generally V-shaped and comprises a first arm 42 and a second arm 44 extending divergently from a common point (not labeled). The first arm 42 forms a spring cantilever 422 deflecting therefrom in a direction away from the second arm 44 while the second arm 44 defines a V-cut 442 in each opposite side of a free end 444 thereof.

The first and second grounding bars 50, 51 are structurally similar to each other; therefore, only the first grounding bar 50 is illustrated in great detail and the second grounding bar 51 may be known by referring to the first grounding bar 50. The first grounding bar 50 comprises a lengthwise base portion 52 being generally U-shaped in cross-section and a pair of tabs 54 extending from the base portion 52. The pair of tabs 54 are spaced from each other a distance equal to that between the pair of slots 362 of the lower cover 34 so that the pair of tabs 54 may be properly inserted through the pair of slots 362, respectively.

Figure 3:
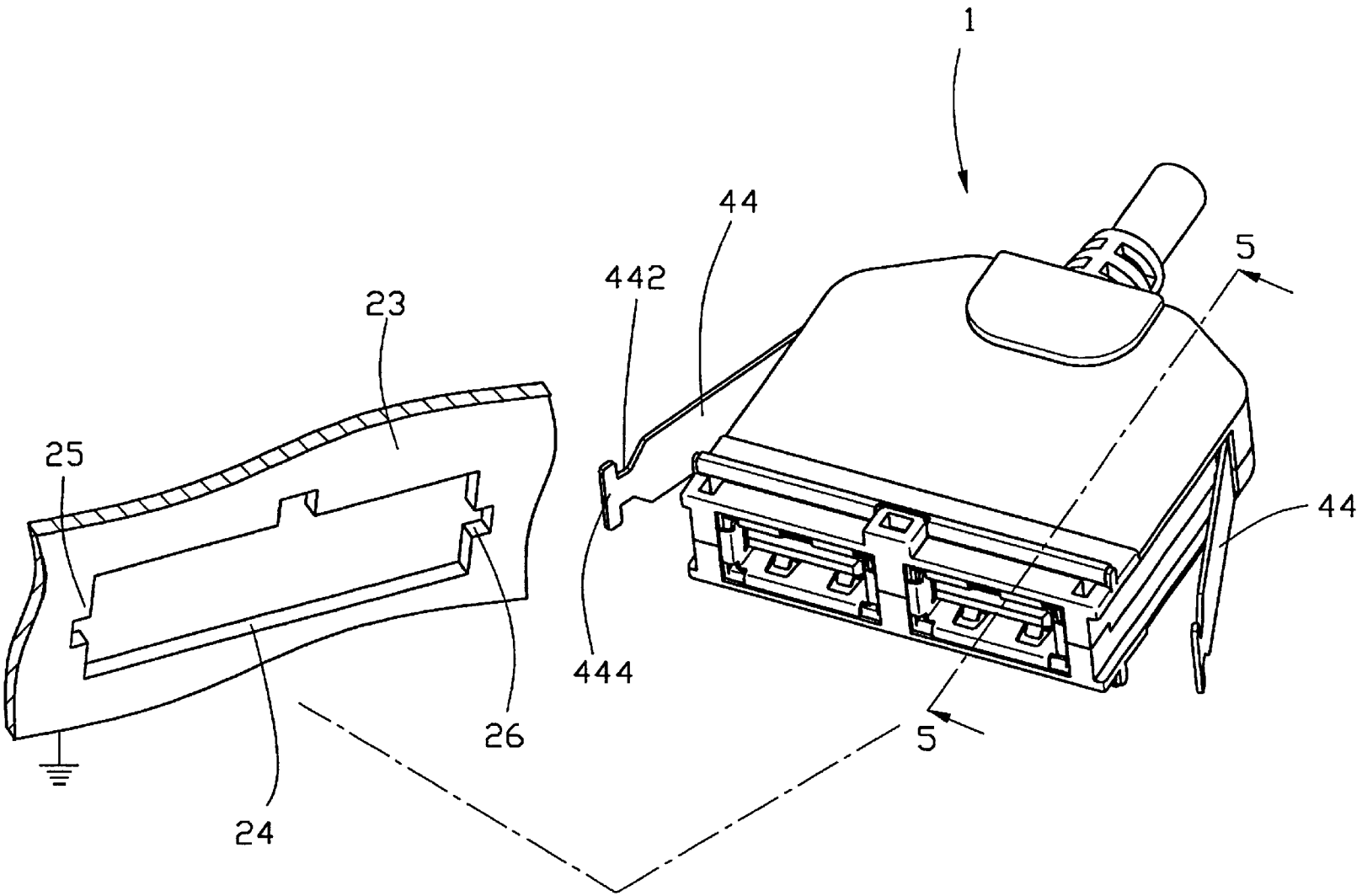
FIG. 3 is an enlarged perspective view of the assembled cable connector assembly of FIG. 1 and a part of a grounding panel of the host device of FIG. 1 in an unmated state.
Figure 4:
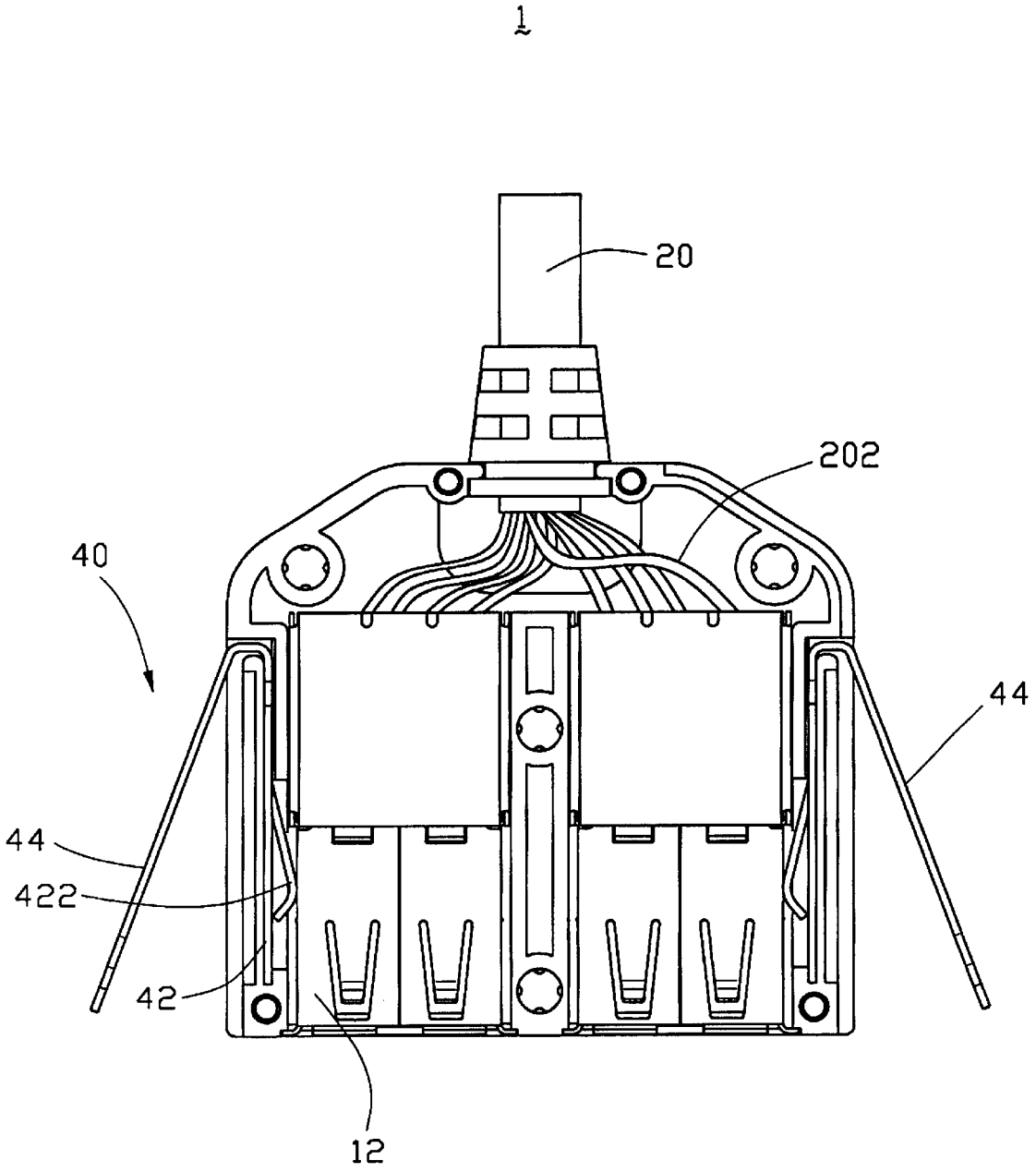
FIG. 4 is an enlarged top planar view of the cable connector assembly wherein an upper cover of the cable connector assembly is removed therefrom to particularly illustrate an inner structure of the cable connector assembly.

Further referring to FIGS. 3 and 4, in assembly, the second and first grounding bars 51, 50 are respectively assembled to the upper and lower covers 32, 34. For example, the U-shaped base portion 52 of the first grounding bar 50 engagably receives the rib 39 of the lower cover 34 and the pair of tabs 54 of the first grounding bar 50 are extended through the pair of slots 362 into the lower cover 34. The tabs 54 are then bent to be deflexedly received in the recesses 364 of the body portion 36 such that free ends of the tabs 54 may reliably engage with the shrouded shells 12 of the second connectors 10, respectively. Simultaneously, the cable end 20 is electrically connected to the pair of second connectors 10 by soldering wires 202 of the cable end 20 to terminals (not shown) of the second connectors 10. The pair of second connectors 10 are then positioned shoulder to shoulder on the lower cover 34 such that bottoms of the shrouded shells 12 abut against the free ends of the tabs 54 of the grounding bar 50, respectively. Thus, the shrouded shells 12 are electrically connected together via the grounding bar 50. The pair of conductive latches 40 are assembled to the lower cover 34 wherein the first arms 42 thereof are engagably received in the pair of channels 382, respectively, and the second arms 44 laterally extend away from the lower cover 34. The spring cantilevers 422 project inwardly to resiliently abut against sides of the shrouded shells 12 of the pair of second connectors 10, respectively. The upper cover 32 is then assembled to and combined with the lower cover 34 by a method or combination of methods as described before while two ports (not labeled) are formed so that the connector assembly 1 can simultaneously connect to the two first connectors 22 of the electronic apparatus 2 (FIG. 2). A pair of tabs 55 of the second grounding bar 51 electrically engages with top portions of the shrouded shells 12 of the second connectors 10 such that static charge accumulated on the shrouded shells 12 may be dissipated therefrom through the first and second grounding bars 50, 51.

Figure 5:
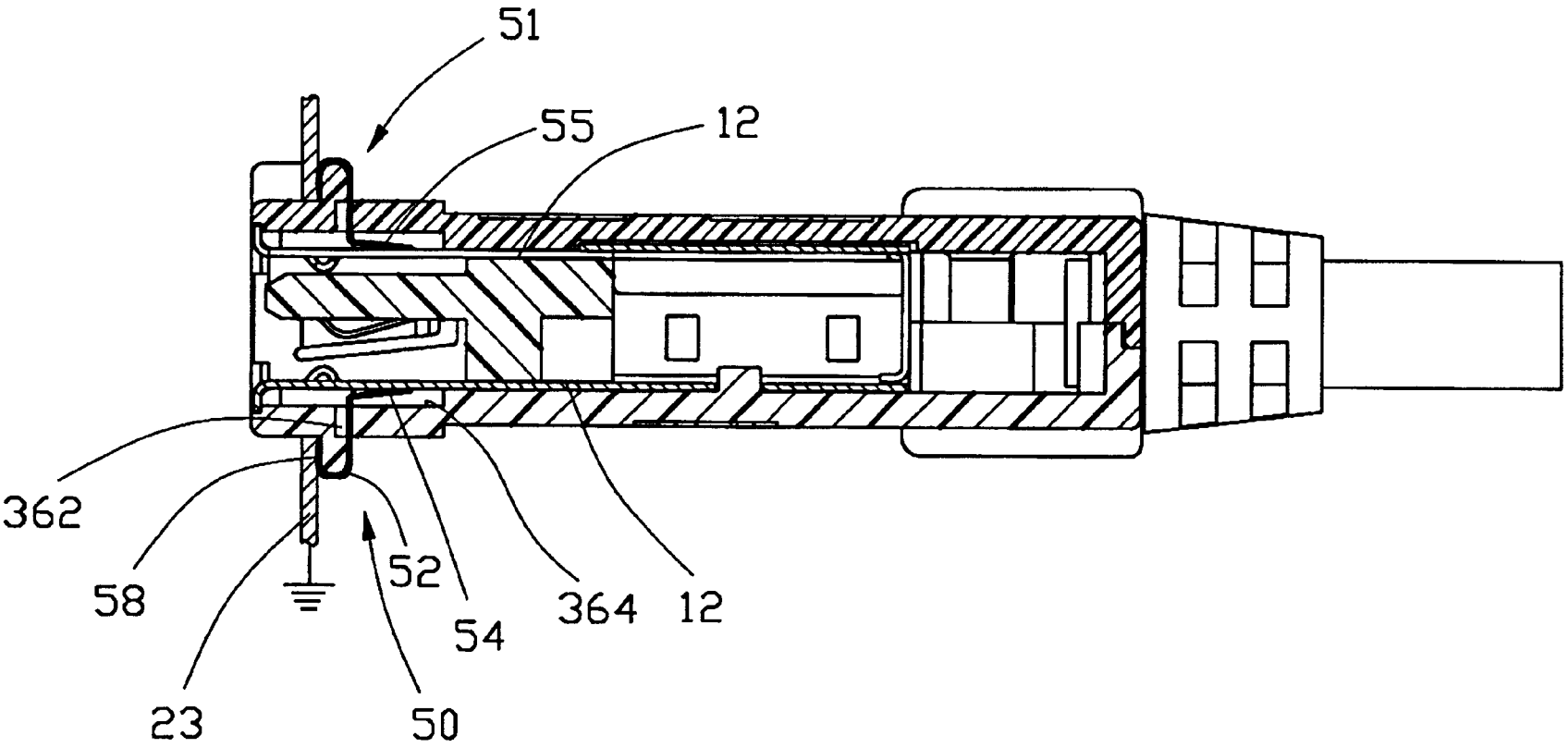
FIG. 5 is a cross-sectional view taken along line 5—5 of FIG. 3 to particularly show a grounding path between conductive shells of the cable connector assembly and the grounding panel of the host device.

Referring to FIGS. 3–5, when the cable connector assembly 1 is mated to the two first connectors 22 of the electronic apparatus 2, the second arms 44 of the pair of conductive latches 40 are inwardly compressed by an external force exerted thereon such that the free ends 444 of them may extend through the opening 24 of the grounding panel 23 at positions beside the first connectors 22 and adjacent the notches 26. After the pair of second connectors 10 mate with the pair of first connectors 22 of the electronic apparatus 2, respectively, the external force is removed and the second arms 44 spring back outwardly. The free ends 444 of the second arms 44 are engagably received in the notches 26 of the grounding panel 23 with the V-cuts 442 receiving edges of the blocks 25 to prevent a disengagement of the cable connector assembly 1 from the electronic apparatus 2. Furthermore, a connecting face 58 of the base portion 52 of the first grounding bar 50 electrically engages with the grounding panel 23 (FIG. 5), as does an identical structure of the second grounding bar 51. Therefore, the shrouded shells 12 are electrically connected to the grounding panel 23, which is further connected to a reference grounding potential, whereby the shrouded shells 12 are also connected to the reference grounding potential and no static charge may accumulate thereon and signals may be successfully transmitted through the second connectors 10.

As described before, the pair of second connectors 10 are arranged together shoulder to shoulder; however, they may also be stacked one above the other. In the preferred embodiment, the second connectors 10 are individually formed. However, as is well known by those skilled in the art, a connector with a housing and a shield and having a two port configuration can be used to replace the two second connectors 10. Furthermore, regarding the preferred embodiment, the second connectors 10 are grounded to the grounding panel 23 via both the pair of conductive latches 40 and the first and second grounding bars 50, 51. However, in alternative embodiments, a selected one of the pair of conductive latches 40 and a selected one of the first and second grounding bars 50, 51 may be adequate to ground the two second connectors 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly matable to a first connector mounted on a conductive grounding panel of an electronic apparatus, the grounding panel being grounded to a reference grounding potential, said electrical connector assembly comprising:

a second connector having a conductive shrouded shell;

a cover enclosing the second connector while providing a port through which the second connector is matable to the first connector;

a pair of conductive latches located in opposite sides of the cover, each latch having a first arm and a second arm, the first arm electrically connected to the shrouded shell of the second connector and the second arm outwardly extending from the cover; and a grounding bar positioned on the cover, said grounding bar having a base portion and a tab extending from the base portion, said base portion extending out of the cover while said tab extends into the cover to electrically engage with the shrouded shell of the second connector; wherein the second arms of the conductive latches and the base portion of the grounding bar are electrically and mechanically engageable to the grounding panel of the electronic apparatus to ground the shrouded shell to the reference grounding potential;

wherein each conductive latch is generally V-shaped and the first and second arms extend divergently from a common point;

wherein the first arm comprises a spring cantilever deflecting in a direction away from the second arm to securely engage with the shrouded shell of the second connector;

wherein the second arm defines a V-cut in each opposite side of a free end thereof for latching with the grounding panel;

wherein the cover comprises a lower cover and an upper cover;

wherein the cover forms a rib on an external face thereof and the base portion of the grounding bar is generally U-shaped in cross section, the base portion receiving the rib therein thereby maintaining the grounding bar on the cover;

wherein the cover defines a slot through which the tab of the grounding bar extends;

comprising a pair of said second connectors each having a shrouded shell, wherein the grounding bar comprises a pair of tabs extending from the base portion thereof into the cover to electrically contact the two shrouded shells of the pair of second connectors, respectively.

* * * * *